US005667317A

United States Patent [19]

Tan

[11] Patent Number: 5,667,317

[45] Date of Patent: Sep. 16, 1997

[54] FLUORESCENT SECURITY SYSTEM FOR PRINTED TRANSACTION RECORDS

[75] Inventor: Yaoping Tan, Miamisburg, Ohio

[73] Assignee: NCR Corporation, Dayton, Ohio

[21] Appl. No.: 520,457

[22] Filed: Aug. 29, 1995

[51] Int. Cl.[6] ..... B41J 27/12

[52] U.S. Cl. ..... 400/197; 400/196.1

[58] Field of Search ..... 400/197, 196.1, 400/202.1, 202.2, 202.4

[56] References Cited

U.S. PATENT DOCUMENTS

| | | | |
|---|---|---|---|
| Re. 34,389 | 9/1993 | Amon et al. | 106/30 B |
| 4,186,944 | 2/1980 | Pearce | 283/8 R |
| 4,451,521 | 5/1984 | Kaule et al. | 428/199 |
| 4,493,572 | 1/1985 | Van Ocker et al. | 400/196.1 |
| 4,598,205 | 7/1986 | Kaule et al. | 250/458.1 |
| 4,880,324 | 11/1989 | Sato et al. | 400/241 |
| 4,884,828 | 12/1989 | Burnham et al. | 283/89 |
| 4,927,180 | 5/1990 | Trundle et al. | 283/70 |
| 5,100,934 | 3/1992 | Glesias | 523/456 |
| 5,290,068 | 3/1994 | Gundjian | 283/67 |
| 5,344,192 | 9/1994 | Phillips | 283/91 |

FOREIGN PATENT DOCUMENTS

| | | |
|---|---|---|
| 0090130 | 10/1983 | European Pat. Off. . |
| 0238043 | 9/1987 | European Pat. Off. . |
| 0282181 | 9/1988 | European Pat. Off. . |
| 0282182 | 9/1988 | European Pat. Off. . |
| 0303725 | 2/1989 | European Pat. Off. . |
| 0327788 | 8/1989 | European Pat. Off. . |
| 0343105 | 11/1989 | European Pat. Off. . |
| 0603117 | 6/1994 | European Pat. Off. . |
| 9212292 | 7/1992 | WIPO . |
| 9306968 | 4/1993 | WIPO . |

*Primary Examiner*—Edgar S. Burr
*Assistant Examiner*—Anthony H. Nguyen
*Attorney, Agent, or Firm*—Craig E. Miller

[57] ABSTRACT

A fluorescent security system for retail transactions which maximizes the printed character or image life of a combination visible/fluorescent inked printing ribbon while ensuring that the fluorescent security life of the combination visible/fluorescent inked printing ribbon will outlast the visible life for printed characters or images under normal lighting conditions. This fluorescent security system for transaction records consists of a fabric ribbon, a dual-roll foam reinker and an optical filter. The fabric ribbon is initially inked with fluorescent ink richer in visible color dye than a normal fluorescent ink to enhance the printed character or image life of the combination visible/fluorescent inked printing ribbon. A dual-roll foam reinker consisting of an inner roll and an outer roll positioned concentric to the inner roll is used to replenish ink depleted from the fabric ribbon during the printing process. The inner roll and the outer roll can have the same or different pore sizes.

18 Claims, 2 Drawing Sheets

FLUORESCENT SECURITY SYSTEM FOR PRINTED TRANSACTION RECORDS

BACKGROUND AND SUMMARY OF THE INVENTION

The present invention relates generally to new and novel improvements in a security system for printed transaction records. More particularly, the present invention relates to a fluorescent security system for printed transaction records including continuous or endless loop visible/security fluorescent printing ribbon cassettes capable of printing visible images and characters, as well as fluorescent security images and characters, on paper or other print receiving medium, such as transaction records.

Personal computers and color copiers in use today can reproduce and create duplicates of transaction records and other documents such that casual inspection cannot reveal which are legitimate original documents and which are reproductions or duplicates. Thus, retail stores and similar establishments are losing thousands, and perhaps millions, of dollars each year due to counterfeit sales receipts, transaction records and other similar documents.

An example of this is where an unscrupulous individual purchases an item at a retail store or similar establishment and obtains a legitimate sales receipt from the store. The legitimate sales receipt is then reproduced. The unscrupulous individual may then return not only the item purchased with the original legitimate sales receipt, but then at some later time can pull this same item from the shelf in the retail store or similar establishment and return it with a counterfeit reproduced sales receipt for an additional refund. Another example is where an unscrupulous individual purchases an item for sale at a sale price significantly lower than the normal retail price and later returns this item with a fraudulent sales receipt for a full price refund. Other examples can be envisioned which make it clear that there is a strong need for security features in sales receipts, transaction records and other similar documents.

Much effort has been made to develop a reliable, cost effective, means of precluding counterfeit sales receipts, transaction records and other similar documents. One method currently in use involves preprinting paper rolls with different colors, custom designs or patterns, or fluorescent inks making it more difficult to reproduce legitimate sales receipts, transaction records and other similar documents. However, it is still possible to acquire one of these papers rolls, either legitimately or illegitimately, from the retail store or similar establishment or from the paper roll manufacturer and then create fraudulent sales receipts, transaction records and other similar documents.

Another approach in use involves adding security features to ink ribbons used to print the sales receipts, transaction records and other similar documents. However, in general, security ink ribbons currently available are either too costly or lose their security features before the inked fabric reaches its visual end of life.

Fluorescent ink is commonly used in security ink ribbons. Fluorescent ink fluoresces under black light distinguishing itself from regular visible ink. However, the character life of a typical combination visible/fluorescent ink printing ribbon is significantly less than that of a regular visible ink ribbon. One reason for this is that the color dye or pigment used in regular visible ink has to be reduced significantly to incorporate a high ratio of fluorescent materials and at the same time obtain a workable level of ink viscosity.

One means of extending the service life of an inked printing ribbon is to incorporate a reinking device which replenishes ink as it is removed from the printing ribbon during use. One type of reinking device commonly in use is a single-roll foam reinker. However, such single-roll foam reinkers cannot significantly extend the character life of a combination visible/fluorescent ink ribbon because the reinker ink has to contain a high percentage of fluorescent materials and the reinker ink is depleted rather rapidly. Since pigments tend to retard capillary action, a reservoir-type reinking system is also not considered suitable for use with inks containing high levels of fluorescent pigments. The lower character life of such combination visible/fluorescent ink printing ribbons causes a significant increase in the cost per printed character.

Fluorescent pigments are becoming more popular over fluorescent dyes because of their excellent stability. However, even with a relatively high percentage of fluorescent pigments used in the ink, fluorescent materials generally still deplete before visible color dyes are depleted. This creates a problem for the user in determining when a combination visible/fluorescent ink printing ribbon should be removed from a printer. Furthermore, the readability of the fluorescent signal depends on the lighting conditions. Under bright light, the light from fluorescent materials is often difficult to see. In many cases, this causes the effective fluorescent life for characters and images printed using known combination visible/fluorescent ink printing ribbons to be shorter than the effective visible life for printed characters and images.

Accordingly, an object of the present invention is the provision of a fluorescent security system for transaction records which provides security features for sales receipts, transaction records and other similar documents with enhanced service life.

Another object of the present invention is to provide a fluorescent security system for transaction records in which the service life of the fluorescent security features for printed characters and images outlasts the visible service life for printed characters and images.

Still another object of the present invention is to provide a fluorescent security system for transaction records which provides an efficient, cost-effective means of printing fluorescent security features on sales receipts, transaction records and similar documents.

Yet another object of the present invention is to provide a fluorescent security system for transaction records which reduces the cost per character printed on sales receipts, transaction records and other similar documents.

These and other objects of the present invention are attained by the provision of a fluorescent security system for retail transactions which maximizes the printed character or image life of a combination visible/fluorescent inked printing ribbon while ensuring that the fluorescent security life of the combination visible/fluorescent inked printing ribbon will outlast the visible life for printed characters or images under normal lighting conditions. This fluorescent security system for transaction records consists of a fabric ribbon, a dual-roll foam reinker and an optical filter. The fabric ribbon is initially inked with fluorescent ink richer in visible color dye than a normal fluorescent ink to enhance the printed character or image life of the combination visible/fluorescent inked printing ribbon. A dual-roll foam reinker consisting of an inner roll and an outer roll positioned concentric to the inner roll is used to replenish ink depleted from the fabric ribbon during the printing process. The inner roll and the outer roll can have the same or different pore sizes. In one preferred embodiment of the present invention, the outer roll has a smaller pore size than the inner roll to reduce the ink transfer rate from the reinker to the fabric ribbon, thus prolonging the printed character or image life of the combination visible/fluorescent inked printing ribbon. Also, the inner roll and the outer roll can be inked with inks having the same or different viscosities. In one preferred embodiment of the present invention, the outer reinker roll is inked with a higher viscosity ink rich in visible color dye or pigment to extend the printed character or image life while the inner roll is saturated with a lower viscosity ink rich in fluorescent materials to ensure that the effective fluorescent life of characters or images printed using the combination visible/fluorescent inked printing ribbon will outlast the visible life of characters or images printed using the combination visible/fluorescent inked printing ribbon.

Other objects, advantages and novel features of the present invention will become apparent in the following detailed description of the invention when considered in conjunction with the accompanying drawings.

DETAILED DESCRIPTION OF THE DRAWINGS

Figure 1:
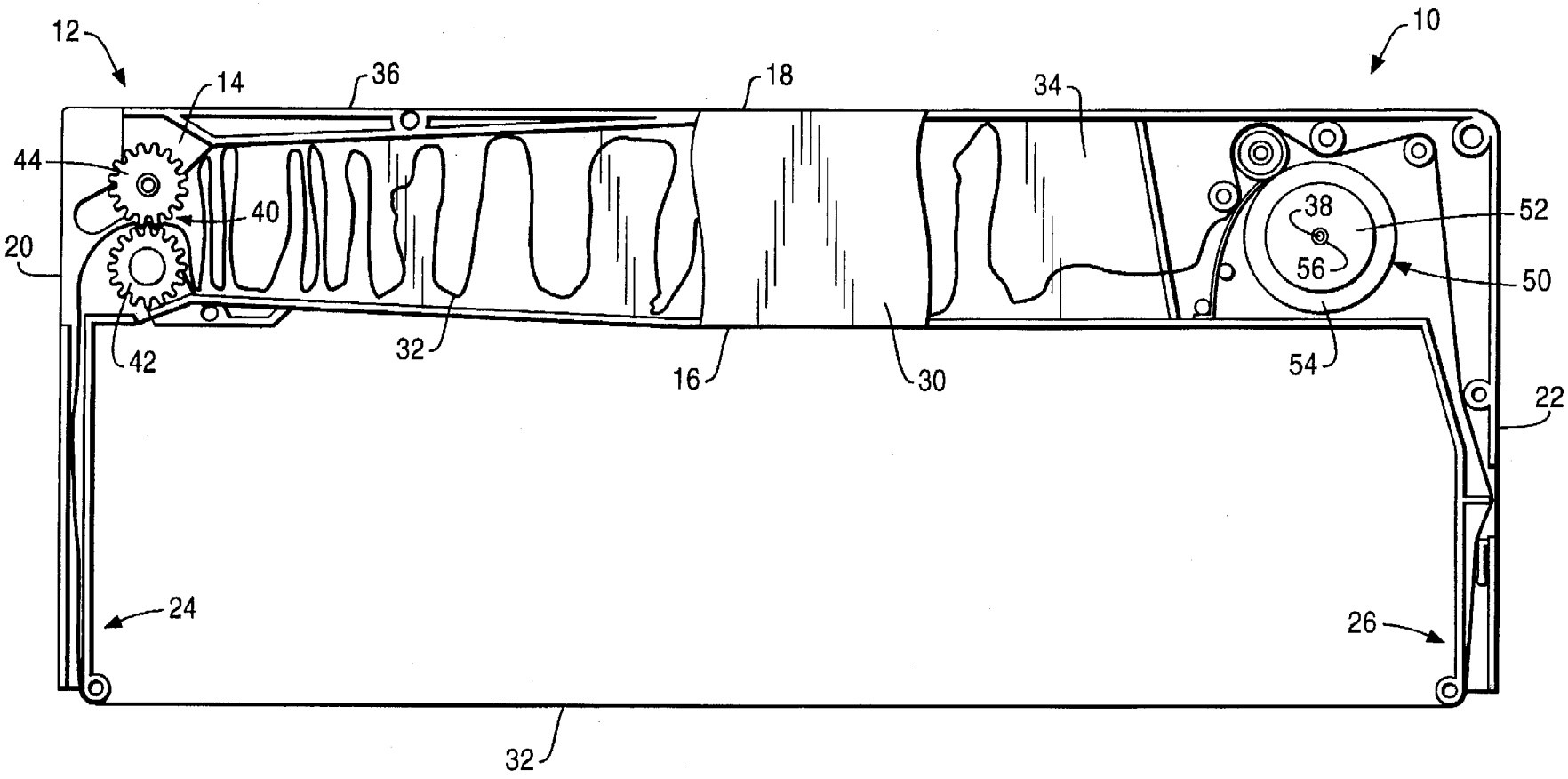
FIG. 1, which illustrates a preferred embodiment of a combination visible/fluorescent inked printing ribbon cassette in accordance with the present invention, shows a top view of representative combination visible/security fluorescent inked printing ribbon cassette with portions of the printing ribbon cassette cover broken away for the purpose of illustration.
Figure 2:
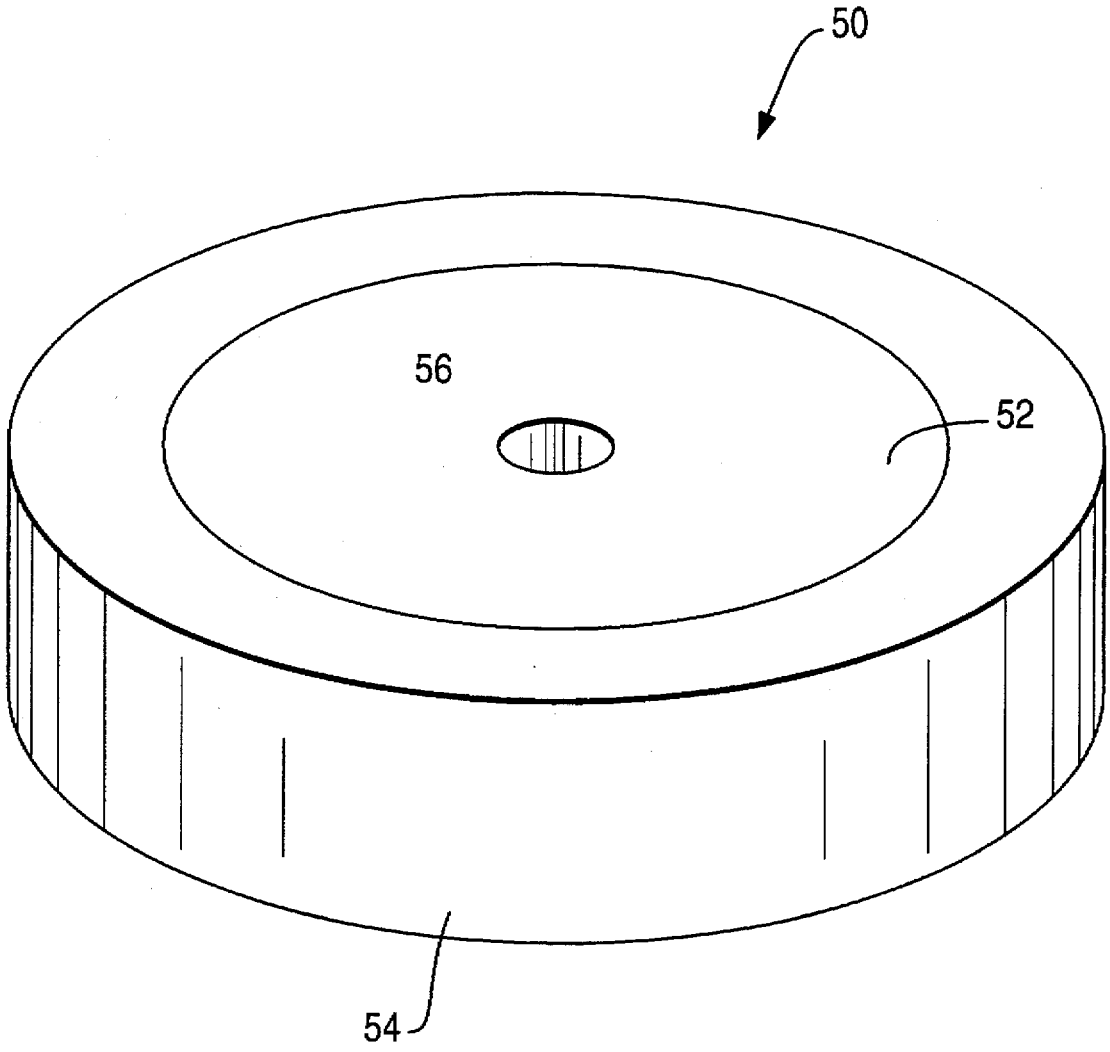
FIG. 2 shows an exploded perspective view of the reinker shown in FIG. 1.

Referring now to the drawings, in which like-referenced characters indicate corresponding elements throughout the several views, attention is first drawn to FIG. 1 which illustrates a preferred embodiment of combination visible/fluorescent inked printing ribbon cassette, generally identified by reference numeral 10, in accordance with the present invention. Combination visible/fluorescent inked printing ribbon cassette 10 generally includes printing ribbon cassette base 12, printing ribbon cassette cover 30, continuous or endless loop visible/fluorescent printing ribbon 32 and printing ribbon drive gear mechanism 40.

Printing ribbon cassette base 12 is preferably of a generally rectangular configuration having bottom portion 14, front portion 16, rear portion 18, inlet side portion 20 and outlet side portion 22. Wall 36 extends upwardly from bottom portion 14 around the perimeter of printing ribbon cassette base 12 along front portion 16, rear portion 18, inlet side portion 20 and outlet side portion 22. Inlet guide 24 and outlet guide 26 assist in controlling the path of continuous or endless loop visible/fluorescent printing ribbon 32 into and out of the printing equipment (not shown).

Continuous or endless loop visible/fluorescent printing ribbon 32 extends outwardly from outlet guide 26, and is fed through the printing equipment (not shown) where a printed image or character is formed by forcing a predetermined portion of continuous or endless loop visible/fluorescent printing ribbon 32, typically by an impact print head (not shown), into contact with a print receiving medium, for example paper (not shown). Continuous or endless loop visible/fluorescent printing ribbon 32 then reenters Combination visible/fluorescent printing ribbon cassette 10 through inlet guide 24 and is stored in printing ribbon storage cavity 34. Since continuous or endless loop visible/fluorescent printing ribbon 32 has no ends, i.e., it forms a continuous loop, such movement can continue indefinitely, or as a practical matter until ink remaining in continuous or endless loop visible/fluorescent printing ribbon 32 is insufficient to produce printed images or characters having adequate visible or fluorescent darkness.

Continuous or endless loop visible/fluorescent printing ribbon 32 is fed into printing ribbon storage cavity 34 by printing ribbon drive gear mechanism 40. Printing ribbon drive gear mechanism 40 includes primary drive gear 42 which is driven by the printing equipment (not shown). Typically, the printing equipment (not shown) indexes primary drive gear 42 a predetermined amount each time a printing operation is performed. Such indexing presents a fresh portion of continuous or endless loop visible/fluorescent printing ribbon 32 to the impact print head (not shown) for each printing operation.

Primary drive gear 42 engages with secondary idler gear 44 to secure continuous or endless loop visible/fluorescent printing ribbon 32 therebetween. Primary drive gear 42 rotates in a direction opposite to that of secondary idler gear 44 to move continuous or endless loop visible/fluorescent printing ribbon 32 held therebetween from inlet guide 24 into printing ribbon storage cavity 34. While various configurations of gear teeth have been utilized on primary drive gear 42 and secondary idler gear 44, applicant has found that a relatively course gear configuration provides several advantages. Such a relatively course gear configuration resists slippage between continuous or endless loop visible/fluorescent printing ribbon 32, and primary drive gear 42 and secondary idler gear 44. Also, a relatively course gear configuration appears to assist continuous or endless loop visible/fluorescent printing ribbon 32 in assuming a more compact storage pattern within printing ribbon storage cavity 34. This more compact storage pattern permits continuous or endless visible/fluorescent printing ribbon 32 of a longer length to be stored in printing ribbon storage cavity 34 of a given volume, thus permitting more printing operations to be performed before the quality of the printed characters or images deteriorate to the point where replacement of combination visible/fluorescent printing ribbon cassette 10 is needed.

Reinking device 50 generally includes inner cylindrical ink roll 52 and outer cylindrical ink roll 54 positioned concentric to inner cylindrical ink roll. This is in contrast to many conventional roll type reinkers which consist of a single pore size porous rubber or reticulated foam. Reinking device also includes central aperture 56 in inner cylindrical ink roll 54. Reinking device 50 is mounted on printing ribbon cassette base 12 by positioning central aperture 56 over upstanding pin 38 extending from printing ribbon cassette base 12. Central aperture 56 is preferably larger in diameter than upstanding pin 38 which allows inner cylindrical ink roll 52 and outer cylindrical ink roll 54 to rotate freely around upstanding pin 38, preferably together as a single integral unit.

In the present invention, continuous or endless visible/fluorescent printing ribbon 32 is initially inked with a ratio richer in the visible color dye or pigments and lower in fluorescent dye or pigments to provide initial printed characters or images which are visibly very dark like those of conventional visible inked printing ribbon cassettes. Inner cylindrical ink roll 52 and outer cylindrical ink roll 54 may or may not use the same pore size porous material. In one preferred embodiment of the present invention, outer cylindrical ink roll 54 is fabricated from a porous material having a smaller pore size than the porous material used to fabricate inner cylindrical ink roll 52. This arrangement reduces the ink transfer rate from reinker 50 to continuous or endless visible/fluorescent printing ribbon 32, thus prolonging the printed character or image life of continuous or endless visible/fluorescent printing ribbon 32. In addition, inner cylindrical ink roll 52 and outer cylindrical ink roll 54 can be inked with inks having the same viscosity or different viscosities. In one preferred embodiment of the present invention, outer cylindrical ink roll 54 is saturated with a higher viscosity ink having a ratio of visible color dyes or pigments to fluorescent dyes or pigments less than that of the ink used in continuous or endless visible/fluorescent printing ribbon 32. In this preferred embodiment of the invention, inner cylindrical ink roll 52 is saturated with a lower viscosity ink having a ratio of visible color dyes or pigments to fluorescent dyes or pigments which is less than that of the ink used to saturate outer cylindrical ink roll 54 to ensure that the fluorescent printed character or image life will outlast the visible printed character or image life of continuous or endless visible/fluorescent printing ribbon 32.

Inks are selected to be sufficiently viscous, in one preferred embodiment of the present invention 1000 centipoise, to prevent fluorescent pigments from settling down during the inking process. This has been found to be particularly important for inking inner cylindrical ink roll 52. Otherwise, inner cylindrical ink roll 52 and outer cylindrical ink roll 54 will absorb a higher ratio of visible dye over fluorescent pigments. As a result, the fluorescent printed character or image life of continuous or endless visible/fluorescent printing ribbon 32 will be less that the visible printed character or image life. Similarly, because the movement of pigments in the thixotropic ink are restricted in their static state, more visible dye will flow into inner cylindrical ink roll 52 and outer cylindrical ink roll 54 than fluorescent pigments during the inking process, thus shortening the effective fluorescent printed character or image life of continuous or endless visible/fluorescent printing ribbon 32.

In addition to the formulation of the ink and the reinker design, the use of an optical filter has been found to be very useful in the fluorescent security system for transaction records in accordance with the present invention. The function of such an optical filter is threefold. First, such an optical filter allows the light emitted from the fluorescent ink to pass through the optical filter while blocking or filtering out other light from the paper background, thus improving the contrast between the fluorescent signal and the paper background. A second function is to block or filter out light from outside sources from reaching the paper or other print receiving medium. Therefore, the readability of the fluorescent signal is improved. A third function is that a properly chosen optical filter can block out most of the ultraviolet light emitted from the black light, thus preventing the operator from being exposed to high levels of ultraviolet light. The selection of an optical filter appropriate for a particular application depends on the wavelengths (or colors) of light emitted from the fluorescent ink and the wavelength of the light reflected from the paper background.

In addition, when fluorescent ink is printed on paper or other print receiving media containing a substantial amount of optical brighteners, the light emitted from the fluorescent ink can be masked and becomes hard to detect or invisible using a black light. Use of a proper optical filter can minimize or eliminate light reflected from optical brighteners in the paper or other print receiving media while permitting light emitted from the fluorescent ink to pass through the optical filter if a sufficient difference exists in the wavelengths of these two lights. This will assist in making the fluorescent signal visible under black light. Such an arrangement can be used in conjunction with combination visible/fluorescent inked printing ribbon cassette 10 described above.

In summary, the fluorescent security system for printed transaction records in accordance with the present invention provides several advantages over known prior art transaction record security systems. Continuous or endless visible/fluorescent printing ribbon 32 is initially rich in visible dye or pigments. Reinker 50 contains inner cylindrical ink roll 52 and outer cylindrical ink roll 54 and in one preferred embodiment of the present invention, inner cylindrical ink roll 52 is inked with a lower viscosity ink richer in fluorescent materials to extend the fluorescent printed image or character life of continuous or endless visible/fluorescent printing ribbon 32 and outer cylindrical ink roll 54 is inked with a higher viscosity ink richer in visible dye or pigments to prolong the visible printed character or image life of continuous or endless visible/fluorescent printing ribbon 32. Reinking device 50 preferably has ink which is nonthixotropic and the ink viscosity is selected to be sufficiently high to ensure successful ink saturation of reinking device 50. In addition, an optical filter is preferably used to enhance the perceived contrast between the light emitted from the fluorescent ink and other background light from the paper background, thus improving the readability of the fluorescent signal. Furthermore, an optical filter can be used to minimize or eliminate light emitted from optical brighteners often used in paper and other print receiving media while allowing light emitted from the fluorescent materials to pass through the optical filter, thus making the fluorescent signal readily visible under black light.

Although the present invention has been described above in detail, the same is by way of illustration and example only and is not to be taken as a limitation on the present invention. For example, although the above discussion has been related primarily to retail transaction receipts, other types of transaction receipts and documents are envisioned, for example, transaction records from automated teller machines (ATMs) or other financial transaction records. Accordingly, the scope and content of the present invention are to be defined only by the terms of the appended claims.

What is claimed is:

1. A combination visible/fluorescent inked printing ribbon cassette for printing transaction records and other documents on printing equipment, said combination visible/fluorescent inked printing ribbon cassette comprising:

a printing ribbon cassette base of generally rectangular configuration having a bottom portion, a front portion, a rear portion, an inlet side portion, an outlet side portion, a continuous or endless printing ribbon storage cavity and an upstanding pin;

a wall extending upwardly from said bottom portion of said printing ribbon cassette base along said front portion, said rear portion, said inlet portion and said outlet portion;

an inlet guide extending outwardly from said front portion along said inlet side portion of said printing ribbon cassette;

an outlet guide extending outwardly from said front portion along said outlet side portion of said printing ribbon cassette;

a continuous or endless visible/fluorescent inked printing ribbon exiting from said printing ribbon cassette through said outlet guide, extending between said outlet guide and said inlet guide, and entering into said printing ribbon cassette through said inlet guide;

a printing ribbon drive gear mechanism for moving said continuous or endless visible/fluorescent inked printing ribbon from said inlet guide into said printing ribbon storage cavity in said printing ribbon cassette base;

a reinking device rotatably mounted on said upstanding pin on said printing ribbon cassette base, said reinking device including an inner cylindrical ink roll saturated with a first ink and an outer cylindrical ink roll saturated with a second ink, said outer cylindrical ink roll concentrically positioned around said inner cylindrical ink roll;

said first ink is richer in fluorescent dye or pigments than in visible color dye or pigments and said second ink is richer in visible color dye or pigments than in fluorescent dye or pigments; and said inner cylindrical ink roll and said outer cylindrical ink roll rotate in response to linear movement of said continuous or endless visible/fluorescent inked printing ribbon and said first and second inks are transferred from said outer cylindrical ink roll to said continuous or endless loop visible/fluorescent inked printing ribbon.

2. The combination visible/fluorescent inked printing ribbon cassette in accordance with claim 1, wherein said inner cylindrical ink roll and said outer cylindrical ink roll rotate as an integral unit in response to said linear movement of said continuous or endless loop inked printing ribbon.

3. The combination visible/fluorescent inked printing ribbon cassette in accordance with claim 1, wherein at least one of said inner cylindrical ink roll and said outer cylindrical ink roll is fabricated from a porous rubber material.

4. The combination visible/fluorescent inked printing ribbon cassette in accordance with claim 1, wherein said inner cylindrical ink roll and said outer cylindrical ink roll are fabricated from a material having the same pore size.

5. The combination visible/fluorescent inked printing ribbon cassette in accordance with claim 1, wherein said inner cylindrical ink roll and said outer cylindrical ink roll are fabricated from materials having different pore sizes.

6. The combination visible/fluorescent inked printing ribbon cassette in accordance with claim 1, wherein said first ink has a lower viscosity than said second ink.

7. The combination visible/fluorescent inked printing ribbon cassette in accordance with claim 6, wherein said first ink includes visible color dye or pigments and fluorescent dye or pigments and said second ink includes visible color dye or pigments and fluorescent dye or pigments and said first ink has a higher fluorescent dye or pigments to visible color dye or pigments ratio than said second ink.

8. The combination visible/fluorescent inked printing ribbon cassette in accordance with claim 7, wherein said continuous or endless loop visible/fluorescent inked printing ribbon is saturated with a third ink and said third ink has a lower fluorescent dye or pigments to visible color dye or pigments ratio than either of said first ink and said second ink.

9. A reinking device for a combination visible/fluorescent inked printing ribbon cassette for printing transaction records and other documents on printing equipment, said combination visible/fluorescent inked printing ribbon cassette having a continuous or endless loop visible/fluorescent inked printing ribbon and a printing ribbon cassette base with an upstanding pin, said reinking device comprising:

an inner cylindrical ink roll capable of being rotatably positioned on the upstanding pin on the printing ribbon cassette base, said inner cylindrical ink roll being saturated with a first ink; and an outer cylindrical ink roll concentrically positioned in relation to said inner cylindrical ink roll, said outer cylindrical ink roll being saturated with a second ink, said outer cylindrical ink roll rotates in response to linear movement of said continuous or endless loop visible/fluorescent inked printing ribbon through said printing cassette and transfers said first and second inks from said outer cylindrical ink roll to said continuous or endless loop visible/fluorescent inked printing ribbon;

wherein said first ink is richer in fluorescent dye or pigments than in visible color dye or pigments and said second ink is richer in visible color dye or pigments than in fluorescent dye or pigments.

10. The reinking device in accordance with claim 9, wherein said inner cylindrical ink roll and said outer cylindrical ink roll rotate as an integral unit in response to said linear movement of said continuous or endless loop visible/fluorescent inked printing ribbon.

11. The reinking device in accordance with claim 9, wherein at least one of said inner cylindrical ink roll and said outer cylindrical ink roll is fabricated from a porous rubber material.

12. The reinking device in accordance with claim 9, wherein said inner cylindrical ink roll and said outer cylindrical ink roll are fabricated from a material having the same pore size.

13. The reinking device in accordance with claim 9, wherein said inner cylindrical ink roll and said outer cylindrical ink roll are fabricated from materials having different pore sizes.

14. The reinking device in accordance with claim 9, wherein said first ink has a lower viscosity than said second ink.

15. The reinking device in accordance with claim 14, wherein said first ink includes visible color dye or pigments and fluorescent dye or pigments and said second ink includes visible color dye or pigments and fluorescent dye or pigments and said first ink has a higher fluorescent dye or pigments to visible color dye or pigments ratio than said second ink.

16. A reinking device for a combination visible/fluorescent inked printing ribbon cassette, comprising:

an inner cylindrical ink roll saturated with a first ink; and an outer cylindrical ink roll concentrically around said inner cylindrical ink roll, said outer cylindrical ink roll saturated with a second ink;

wherein said first ink has a lower viscosity than said second ink.

17. The reinking device of claim 16 wherein said first ink is richer in fluorescent dye or pigments than in visible color dye or pigments and said second ink is richer in visible color dye or pigments than in fluorescent dye or pigments.

18. The reinking device of claim 17 wherein both said inner cylindrical roll and said outer cylindrical roll are fabricated from a material having the same pore sizes.

* * * * *